US005570540A

United States Patent [19]

Womack et al.

[11] Patent Number: 5,570,540

[45] Date of Patent: Nov. 5, 1996

[54] SEEDLING HOUSE

[76] Inventors: Ellouise Womack; Billie F. White, both of 1939 Linden, Memphis, Tenn. 38104

[21] Appl. No.: 434,072

[22] Filed: May 3, 1995

[51] Int. Cl.[6] ..... A47G 7/00

[52] U.S. Cl. ..... 47/39; 47/60; 211/186

[58] Field of Search ..... 211/186, 72, 135, 211/153; 47/39 S, 60 NL, 39

[56] References Cited

U.S. PATENT DOCUMENTS

| | | | |
|---|---|---|---|
| 147,849 | 2/1874 | Leslie . | |
| 454,772 | 6/1891 | Sugar | 211/74 |
| 570,972 | 11/1896 | Wallis | 211/74 |
| 723,964 | 3/1903 | Wilson | 211/74 |
| 731,710 | 6/1903 | Renken | 211/74 |
| 1,153,028 | 9/1915 | Chalk . | |
| 1,713,908 | 5/1929 | Lane | 211/128 |
| 1,740,057 | 12/1929 | Babick . | |
| 2,957,274 | 10/1960 | Colvin | 47/37 |
| 4,515,280 | 5/1985 | Shea | 211/186 |
| 4,850,134 | 7/1989 | Snekkenes | 47/60 NL |
| 4,899,487 | 2/1990 | Brownlee | 47/41.01 |
| 5,095,649 | 3/1995 | Brownlee | 47/41.01 |

*Primary Examiner*—Henry E. Raduazo
*Attorney, Agent, or Firm*—H. Roy Berkenstock

[57] ABSTRACT

A seedling house for the germination and growing of seedling vegetables and flowers for the hobbyist gardener which is decorative and attractive, portable and disassemblable. In assembled relation, the seedling house includes shelves arranged in an ascending, step-wise fashion adapted with openings to receive plant pots containing the seeds or seedlings to be grown. The seedling house may be adapted with a covering and lighting to enhance the temperature/soil moisture growing conditions for the particular seeds/seedlings being grown.

12 Claims, 4 Drawing Sheets

SEEDLING HOUSE

BACKGROUND OF THE INVENTION

This invention relates to seedling starting frames, or seedling house, for the plant or garden hobbyist or horticulturist. The urban gardener frequently is limited in space for the setting out of seedlings from starting pots which have been germinated indoors because of the conventional utilization of living space in the house or apartment for traditional function. The urban gardener is faced with the choice of dedicating a portion of sleeping, eating or living rooms of the house or apartment to the gardening effort and loss of utility of the area or the pursuit of the hobby in full view of visitors. While the trappings of the gardener produce the beauty and joy of mature fruit and flowers, pots, cold flats and peat pots don't always add to the pleasantness and order of the usual sitting room. The present invention provides an attractive plant starting frame which will complement the decor of the living space and may be conveniently disassembled or folded for storage during the period of non-use.

Moreover, the present invention provides both a decorative and attractive aspect to the in-house gardening function. With the disclosed seedling house, the structure may be readily assembled and utilized for the period necessary to germinate and grow such as garden vegetables to sufficient size that they may then be transplanted to the outdoor location to grow and mature. The seedling house may then be quickly be disassembled and stored for the next opportunity for use. In the interim of the growing season, the seeding house provides an attractive, compact and functional addition to the living space of the house or apartment. While the structure is functional and sturdy, the simplistic design and assembly provides an attractive help-mate to the gardener's tools.

Further application of the present invention may be found in the portability of the seedling house as used for early planting of vegetable seedlings. In such application, the seedling house may be set out of doors during the warmer, sunny days to encourage the germination and growth of the seeds. The frame is then readily returned indoors for the cool evenings or colder, dark days which could inhibit plant growth. The outdoor use of the seedling house is enhanced by the inclusion of an illustrated cover, with which the warmth of the sun is enhanced and the soil moisture evaporation is inhibited.

DESCRIPTION OF THE PRIOR ART

While there are numerous devices illustrated in the prior art for the growing of plants and/or flowers, there are none directed to periodic indoor usage. Likewise, none are adapted for the germination of seeds and growing of seedlings for the hobbyist or urban gardener who needs a compact, attractive structure that may be quickly and easily disassembled and stored during the off-season period.

An early device is that illustrated in U.S. Pat. No. 147,849 to T. Leslie. The illustrated Flower Stand is a decorative outdoor structure (or for use in a large indoor areas such as an enclosed arboretum) including internal watering and drainage system. The focus of this invention is in such arrangement of supply, drainage and basin systems as to ensure adequate yet contained watering of the plants. Later improvements to plant and flower stands are illustrated in U.S. Pat. No. 1,153,128 to Chaulk and U.S. Pat. No. 1,720,057 to Babich. Both of these structures are inverted conical devices having ringed or circular adaptations for the placing of plants and flowers. Likewise, both structures are constructed primarily for the growing or display of mature plants, though the Babich Plant Propagator does describe the growing of the plants from seed. The Babich device is a large concrete or pottery-type, earth-filled structure suitable for outdoor display in decorative garden arrangement. The Chalk stand is designed for primary use of flower display, either for commercial use or a large internal display such as would be utilized in the lobby of an office building. Both devices include watering/drainage systems to ensure adequate moisture to the contained vegetation.

More recent related patents to Brownlee, U.S. Pat. No. 4,899,487 and U.S. Pat. No. 5,095,649 illustrates a structure with several tiers, however the invention is directed to a commercial floral display or storage device. As with the previously described structures, intricate watering and drainage schemes are included rendering the device large, cumbersome and ill-suited for home or apartment usage. Likewise, the Brownlee inventions are not readily disassembled for storage or periodic usage.

SUMMARY OF THE INVENTION

The present invention provides a seedling house for the hobbyist gardener which is attractive, functional and readily assembled and disassembled for the periodic use contemplated by such a person. The seedling house is sturdy when assembled and capable of providing additional desirable features to the hobbyist. Includable are individual seedling containers that are readily removed when the plant reaches sufficient maturity to be translated to a vegetable garden, or to a decorative pot in the case of flowers or shrubs. Additional features permit the ready assembly and disassembly for storage of the seedling house including such as interlocking frame and shelves, multi-function pins for fastening shelving and support structure.

Other objects of the invention include a growth cover to protect and enhance the germination and growing of the plants. Preferably the growth cover is a translucent material and serves to retain a favorable humid atmosphere for the plants and enhances the warming effect of sunlight by allowing the light to directly impinge upon the growth environment however retaining the heating effect over a prolonged period. In keeping with the objectives of ready assembly and disassembly, the growth cover is adapted to be quickly, yet securely, fastened to the seedling house for the periods when its usage is preferable.

Additional objects of the seedling house invention include an integral case for the support and storage of the seedling house during the relevant periods therefor. Included in the several objectives of the integral case are means for the securing of seedling house walls for structural strength and means to facilitate storage of the several components of the seedling house so that tit may be readily reassembled as desired.

These and the several other objectives of the seedling house invention will be more readily apparent from the following description of the preferred embodiments as such are considered in conjunction with the appended drawings and attached claims.

DETAILED DESCRIPTION OF THE PREFERRED EMBODIMENTS

Figure 1:
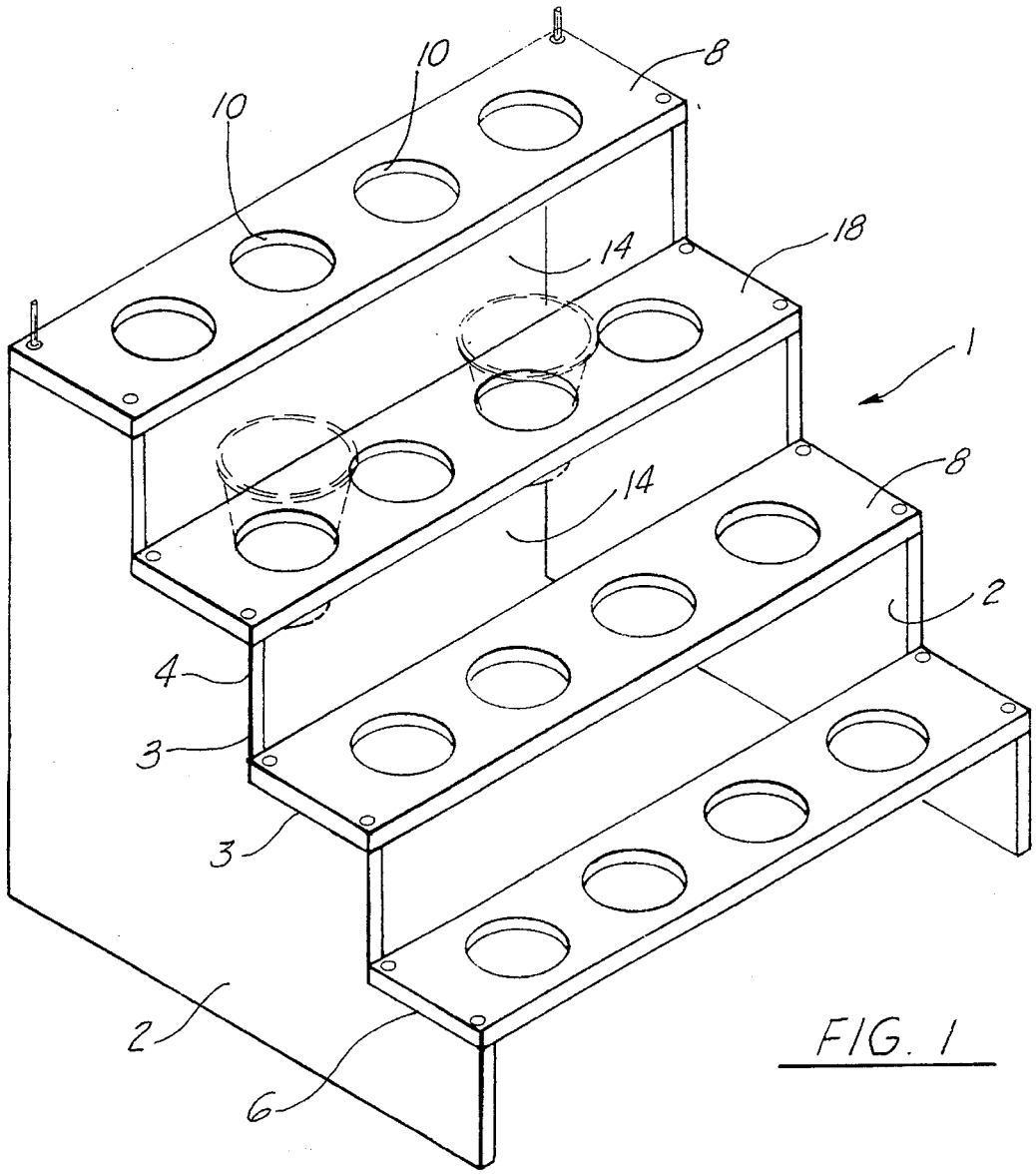
FIG. 1 is a perspective view of a seedling house for the germination of seeds and protection of seedlings during their growth to the time to be set out, according to the present invention.

The seedling house 1 illustrated in FIG. 1 includes side walls 2 arranged in parallel, vertical alignment. Side walls 2 are adapted with a stepped profile edge 3 on one side including riser 4 and shelf support 6. A plurality of shelves 8 are mounted on shelf supports 6, and each of the shelves 8 are adapted with openings 10 for receiving plant containers or starter pots 12. In the embodiment illustrated in FIG. 1, each shelf 8 includes a plurality of openings 10, arranged generally linearly along the length of the shelf. For matters of convenience and economy, the openings 10 are adapted to be circular and of a diameter to accept one or more of a variety of peat cups which are commercially available in hardware stores and nurseries. Alternatively, the seedling house 1 might utilize include the smaller drinking (bathroom-size) cups. It is advantageous to use as small a container 12 as a particular seedling will permit so as to maximize the numbers of starter cups 12 on a particular shelf 8. Likewise, as may be appreciated, shelves 8 may be adapted with openings 10 of different diameters so as to permit the placement of a variety of sizes of starter cups 12 thereby accommodating plants of different sizes at transplanting maturity. The experienced gardener will recognize that such as tomato plants are customarily larger in size at "setting out" than are peppers.

Figure 1A:
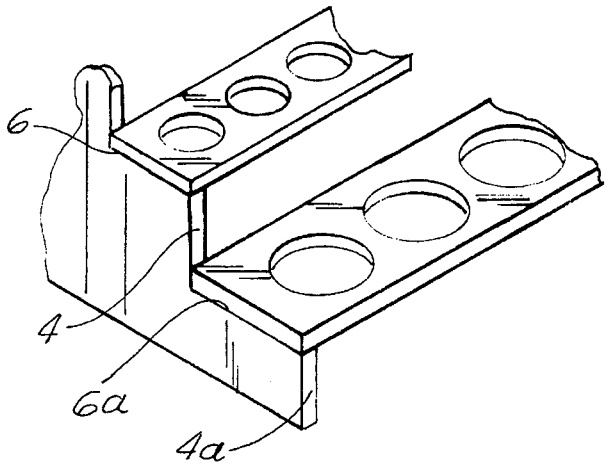
FIG. 1*a* is a partial perspective view of an alternative embodiment of the invention illustrating accommodation for varying sized seedlings.

In the seedling house 1 illustrated, the width, breadth and height of the house are conveniently 24 inches each. Risers 4 and shelves are conveniently 3 inches in height and depth, respectively. Though risers 4 and shelf supports 6 are illustrated as having relatively equal dimensions in FIG. 1, it is considered within the scope of the present invention to vary the sizes of risers 4 and shelf supports 6 such that the seedling house may be adapted to accommodate seedlings of varying sizes on selected shelves 8. Reference to FIG. 1*a* illustrates such an alternative embodiment wherein risers 4 and 4*a* are of different sizes as are shelf supports 6 and 6*a*. Accordingly, shelves 8 and 8*a* are of comparable sizes to their respective riser and shelf supports such that starter cup 12*a* of shelf 8*a* may accommodate a larger seedling whereby sections of the seedling house may thus accommodate the different size needs of a variety of seedlings being grown by the gardener. Also considered to be within the scope of the invention is the embodiment wherein shelf support 6 is adapted to receive any of a variety of shelves 8 each having a different selection of larger or smaller openings 10 such that the gardener may elect to place either larger or smaller pots 12 according to the type of seedling being planted.

Figure 2:
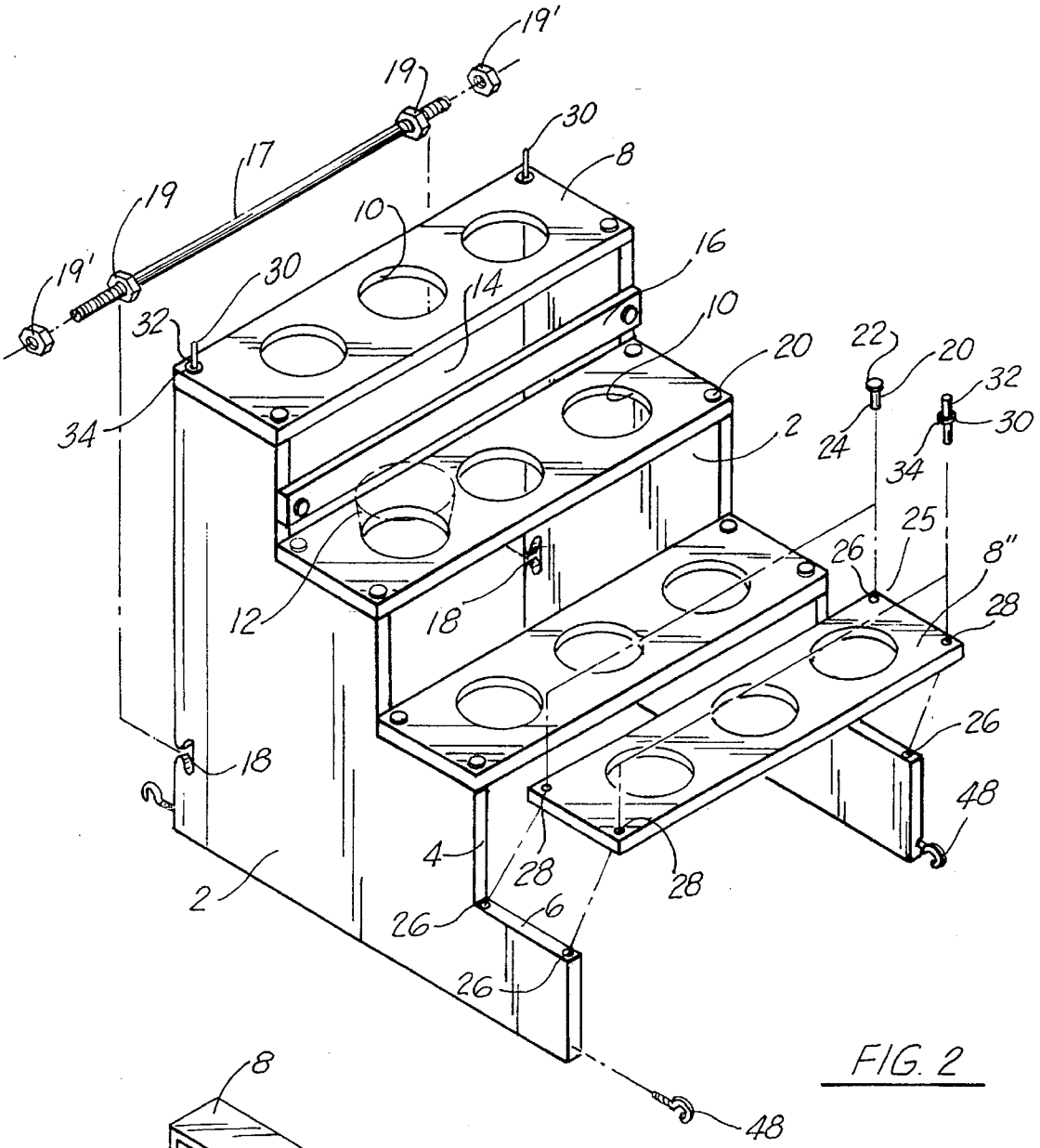
FIG. 2 is a partially exploded perspective view of alternative embodiments to the present invention.

In the embodiment of the seedling house 1 illustrated in FIG. 1, risers 4 are unadorned with any closure device, as a slat or screen whereby an airspace at 14 exists between adjacent shelves 8. The experienced gardener will recognize that some general flow of air around plants is advantageous for the prevention of fungus, molds and harmful bacteria. While the space between adjacent shelves 8 is illustrated as completely open, it is considered to be within the scope of the present invention to partially close the airspace 14 as is illustrated in FIG. 2 wherein a slat 16 is disposed on the riser 6 and intermediate adjacent shelves 8. The placement of the slat 16 at the top, bottom or intermediate the airspace 14 is a matter of gardener's choice, depending upon relative growing conditions and the particular selection of plants. The slat is preferably affixed to the riser in the manner described below for shelves 8.

Referring further to FIG. 2 the various means for securing the various components of the seedling house in an assembled arrangement are illustrated. As in FIG. 1, the seedling house 1 is illustrated in pictorial view partially exploded for ease in illustrating the various mechanisms for securing the components of the seedling house 1. Side walls 2 are in parallel vertical relationship and the upper two shelves 8 are illustrated in assembled condition. The bottom-most shelf 8" is illustrated in exploded fashion so that it may be appreciated how pins 20 cooperate with shelves 8, by which a secure, yet readily assembled and disassembled seedling house is achieved. Pins 20 include head 22 disposed on shaft 24. In assembled condition as illustrated at 25 pin 20 is inserted in pin opening 26 in side 2 in the shelf support 6, having been inserted through a cooperating shelf pin opening 28 in shelf 8. In the illustrated embodiment of FIG. 2, pin 20 is fully seated against shelf 8. Likewise, in the preferred embodiment illustrated, pin opening 26 and shelf pin opening 28 are of a diameter and depth to snugly receive pin shaft 24 such that the friction occurring between them provides a mechanical link adding rigidity to the seedling house 1 structure. Material preferably utilized for sides 2 and shelves 8 is selected from a group of building materials including woods and plastics which are readily available in sheet configuration and on the order of one-eighth inch to one-half inch in thickness. Naturally, choice of material will be determined by the relative size of the seedling house 1 desired as well as the load to be imposed by the seedling pots 12 and such choices are considered within the skill of an experienced fabricator. It should be recognized by those skilled in the art that a functional alternative is to dispose a screw thread (as are commonly found on wood screws and multi-purpose hooks) on pin shaft 24 whereby the pin 20 might be turned into pin opening 26 and a similar mechanical link established. Additionally, pin head 22 may be adapted with a conventional standard or Phillips-type slot or a conventional bolt-head configuration should a user determine that additional control is required for insertion of pins 20 into sides 2. Slats 16 may be affixed to risers 4 with pins 20 in a manner similar to that described above. It should be also recognized that the addition of slats 16 will provide additional structural support when in place. Likewise, in the instance that a fabricator elect to form sides 2 and shelves 8 of a plastic or similar material, it is considered within the scope of the invention to adapt shelves 8 or sides 2 with pin means 20 (as being integrally molded therein) to be received within a complementary opening 26 in a respective side 2 or shelf 8. Through known snap-fit or equivalent locking means, the desired structural integrity may be readily achieved.

Figure 2A:
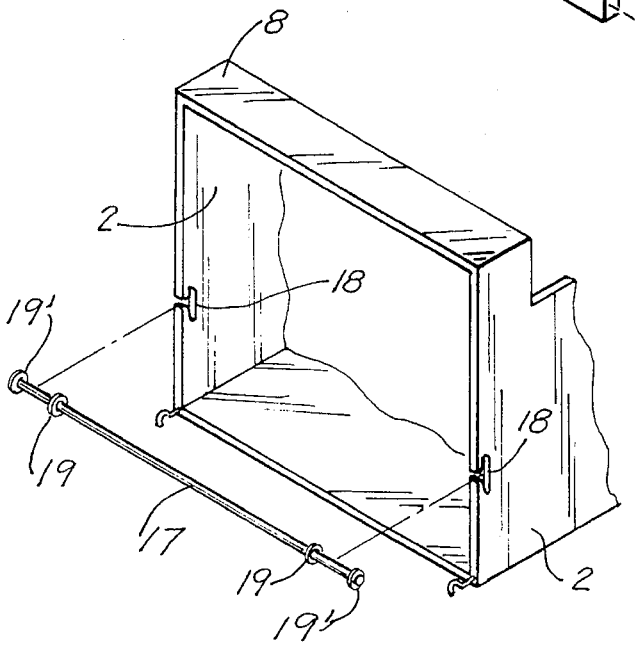
FIG. 2*a* is a rear perspective view of an alternative embodiment of the present invention illustrating optional bracing for the seedling house.

Thus, it may also be preferable, depending upon how large a fabricator elects to construct a seedling house 1 (as by enlarging sides 2 and providing a greater number of shelves as are illustrated herein) one or more slats 16 might be disposed at the back of the seedling house so as to connect sides 2. An alternative embodiment for additional structural security is illustrated by the inclusion of bar 17 disposed within slots 18 and closely received therein. Disposed on bar 17 at the ends thereof am heads 19 which preferably are so located by sizing of the length of bar 17 so that heads 19 engage sides 2 when bar 17 is disposed in slots 18. Additional structural support may be achieved by including second heads 19' disposed adjacent heads 19, however spaced apart therefrom a distance approximately equal the thickness of sides 2. Such a bar 17 and head 19, 19' configuration may be constructed of a rod, threaded at the ends including a pair of suitably sized nuts threaded thereon. Likewise, bar 17 may be specially fabricated including heads 19, 19' secured thereon by welding or equivalent means. FIG. 2*a* further illustrates the manner in which bar 17 may be received into slots 18 such that adjacent heads 19, 19' may receive sides 2 therebetween.

Figure 3:
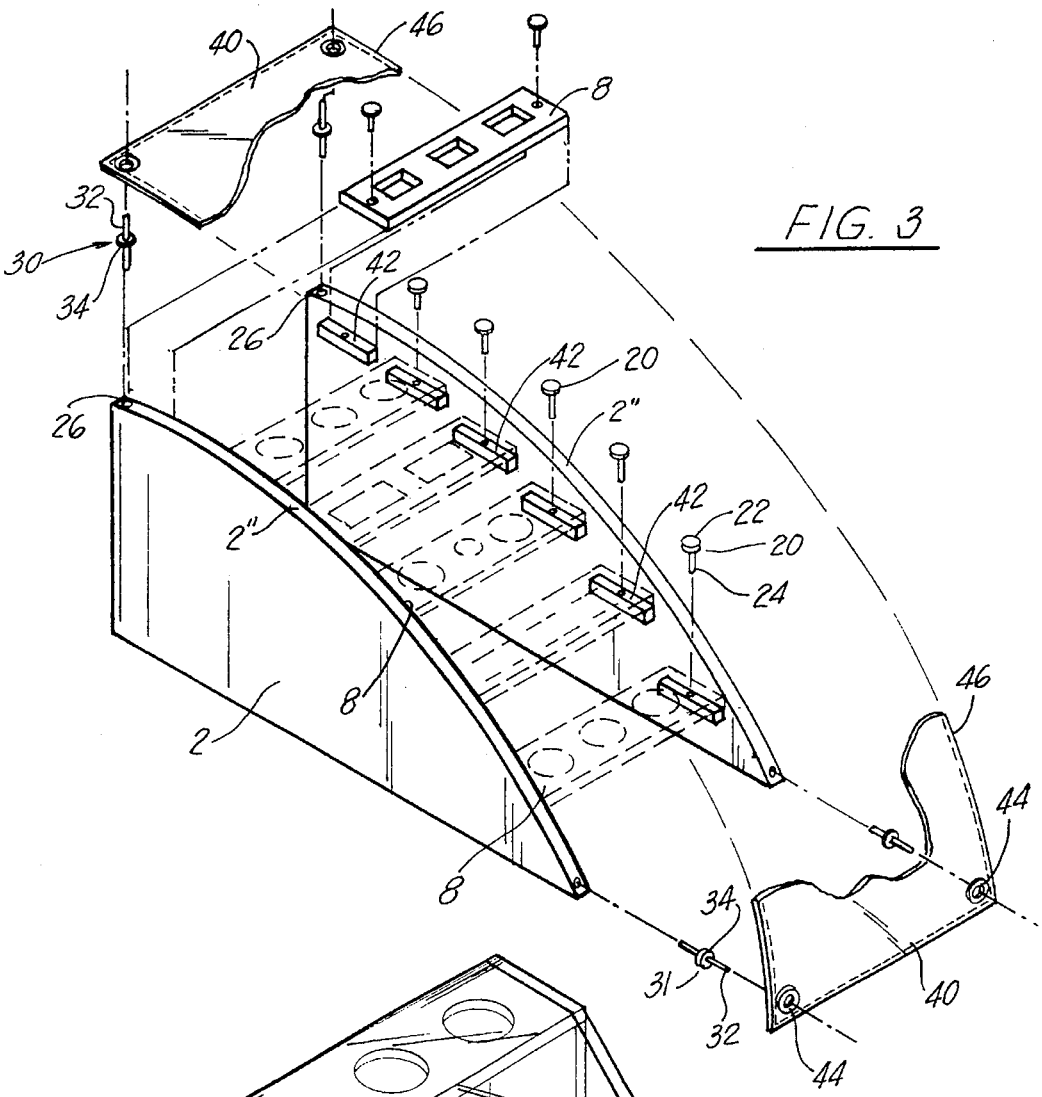
FIG. 3 is a partially exploded perspective view of still further alternative embodiments to the present invention, including optional cover and an alternative profile.

Continuing with FIG. 2, and referring now to end pins 30 which are disposed in the foremost and rearmost positions on the top and bottom shelves 8 of the seedling house 1, it will be observed that a pin extender 32 is disposed on the upper side of pin head 34. End pins 30 may otherwise be similar to pins 20 in construction and usage. Such end pins 30 are advantageously utilized when a translucent cover such as is illustrated in FIG. 3 is disposed over the starting cups 12. As will be evident to experienced gardeners, the greenhouse effect of such a translucent cover facilitates the germination of seeds through the retention of heat and moisture in the grow space.

Turning now to FIG. 3, an alternative embodiment of a seedling house 1 is illustrated which includes a cover 40 disposed in extending relation from top to bottom of seedling house 1 over shelves 8. As was earlier described, the inclusion of cover 40 is advantageous when the seedling house 1 is transported out of doors during daylight hours to take advantage of the warming and growth inducement of natural sunlight. Cover 40 serves to enhance and retain both the warmth of the sunlight and assist in the retention of soil moisture.

In the embodiment illustrated in FIG. 3, seedling house 1 includes side portions 2 which are generally curved or arcuate in shape along their edges 2" adjacent the shelves 8. Disposed along the interior surfaces of sides 2 are shelf supports 42 which function in a fashion analogous to shelf supports 6 in FIG. 1. Shelf supports 42 are conveniently rectangular bead material tacked, glued or otherwise secured to sides 2. As in the embodiment illustrated in FIG. 1, the shelves 8 are disposed in stepped relation from the lowermost shelf to the uppermost shelf. Shelves 8 are affixed to shelf supports 42 with pins 20 similar to, and in similar manner as, those illustrated in FIGS. 1 and 2. In the illustrated embodiment, single pins are used on each end of shelves 8 with supports 42. As was described in the earlier embodiments, the numbers and types (threaded or smooth, circular or of other cross section) of pins 20 and 30 are optional to the fabricator.

Cover 40 is made of a translucent and readily formable material such as clear or slightly opaque plastic and is optionally disposed over shelves 8 being supported by sides 2 at their edges 2". Cover 40 includes grommets 44 at operative locations, such as at the corners of cover 40 whereby the cover 40 may be readily attached to sides 2. In the illustrated embodiment, grommets 44 are placed over pin extenders 32 of end pins 30. Cover 40 is sized so as to approximately extend over the entire surface area described by shelves 8, between sides 2. In such arrangement, cover 40 forms a green house like structure with seedling house 1 whereby a more stable moisture and temperature environment advantageous to germination of seeds may be created. Cover 40 in FIG. 3 contains a reinforced border 46 which is conveniently formed by doubling of the material at the edge and stitching, either with thread or by glue or thermal bond.

As an alternative to moving the seedling house 1 out of doors for natural sunlight, artificial light may be utilized to enhance the growth environment. It may be convenient to place a light stand outfitted with any incandescent or florescent bulb adjacent seedling house 1. Inclusion of an ultra violet light producing bulb such as are available in garden shops provides an enhanced growing environment. Likewise, the seedling house 1 may be conveniently fitted with such as a small florescent tube type ultra violet light bulb. Such tubes may be placed on the under sides of shelves 8, thereby being located proximate and above the adjacent lower shelf. By such self-contained growth enhancing lights, seedling house 1 may be located in a wider variety of locations indoors, including those with minimal natural light.

Figure 4:
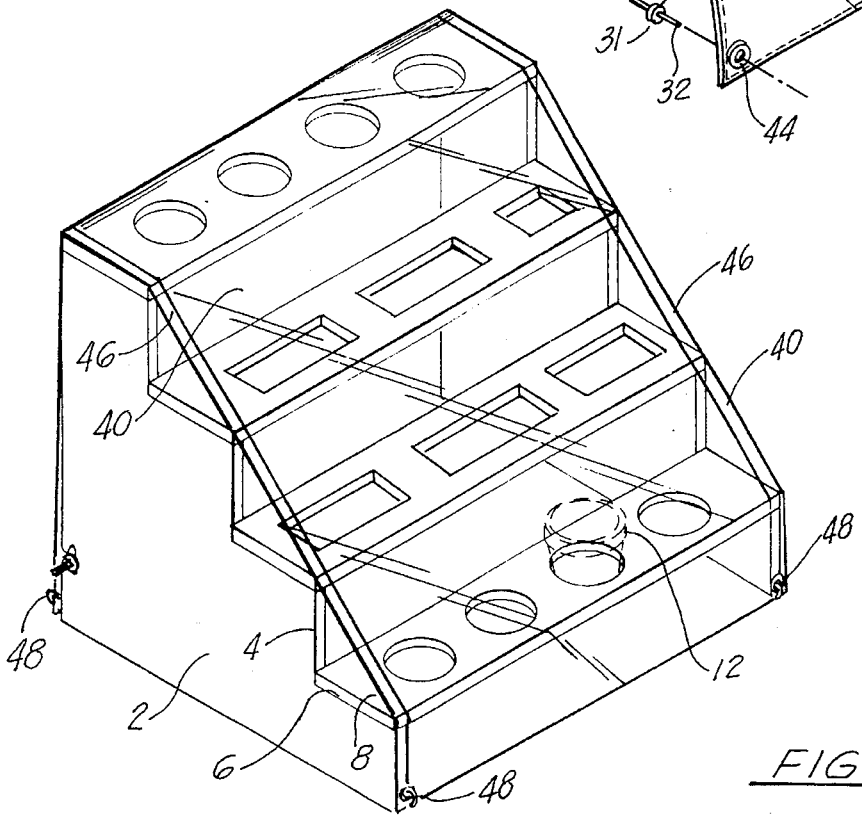
FIG. 4 is a perspective view of further alternative embodiments of the various elements to the seedling house of the present invention.

FIG. 4 illustrates an alternative embodiment of seedling house 2 wherein the cover 40 is disposed over the style of seedling house 1 illustrated in FIG. 1 and extends over the back portion to be secured at the rear base of sides 2. This embodiment illustrates the manner in which cover 40 may be disposed over a variety of styles of seedling house 1 and be optionally disposed over the shelf area or more fully encase the seedling house. In this illustrated embodiment, cover 40 is secured at its respective ends using such as hooks 48 (which are also illustrated in FIG. 2) rather than pins 30. All of these embodiments are considered within the scope of the present invention.

Figure 5:
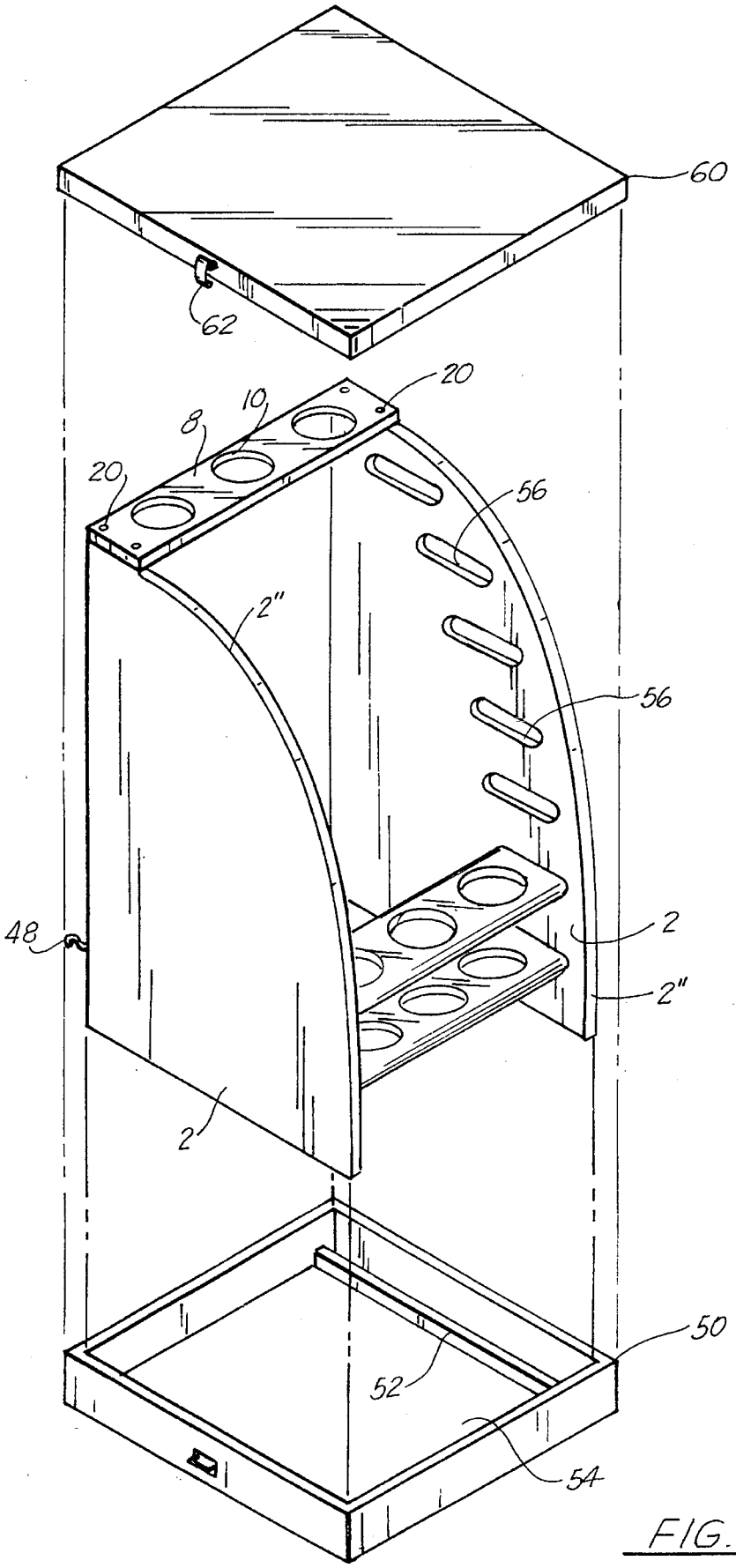
FIG. 5 is a perspective view of the seedling house according to the present invention including embodiments for a supporting case and storage capacity.

FIG. 5 illustrates further alternatives for embodiments of the present invention wherein seedling house is adapted to be mounted within a carrying case 50 which may contain all of the respective elements of the seedling house 1 when disassembled and stored therein. Case 50 conveniently includes means such as bead 52 which is disposed inside case 50 on the interior of base 54. Bead 52 may be formed of rectangular material and affixed therein in a manner similar to shelf supports 42 which are illustrated in FIG. 3. Case 50 includes top 60 which cooperates with base to be secured when closed. Such means for securing top 60 to base 54 may include hinges, hooks 62, clasps and related hardware, all of which are commercially available and the use of which is within the skill of an experienced fabricator, cabinet maker or carpenter.

FIG. 5 further illustrates an alternative embodiment of the arrangement of shelves 8 in tiers within sides 2. In this embodiment, shelves 8 are received within slots 56 disposed within the interior of sides 2 at intervals similar to shelf supports 6 of FIG. 2 or shelf supports 42 of FIG. 3. Such a construction of shelves as is illustrated in FIG. 5 is particularly feasible in conjunction with the mounting of seedling house 1 including cover 50 as is also illustrated. Disposing sides 2 in beads 52 within base 54 maintains sides 2 in secure relationship within base 54 so that additional means for securing shelves 8 to sides 2 are not required. It is preferable however, to secure top-most shelf 8" to sides 2 in a manner as described in relation to the other Figures such that the necessary structural security is maintained at the top of seedling house 1 as assembled.

These and other embodiments of the invention described and illustrated in the appended drawings are to be understood as inclusive and not exclusive and that various other forms and changes may be perceived without departing form the spirit and scope of the invention herein disclosed and claimed.

What is claimed is:

1. A seedling house for the germination and early growth of garden plants comprising;

a. a pair of side walls disposed in generally vertical, parallel relation;

b. a plurality of shelves disposed in generally horizontal, parallel, ascending, spaced relation between said side walls;

c. shelf support means disposed on said side walls to support said shelves in said generally horizontal, parallel, ascending, spaced relation, said support means supporting said shelves in ascending, spaced relation whereby a ventilation space is disposed between said shelves, between said side walls;

d. pin means adapted to be slidingly received through said shelves proximate the ends thereof and into respective of said shelf support means whereby said shelves are detachably secured to said side walls and shelf support means; and e. seedling cup support means disposed in said shelves whereby seedling cups may be detachably received in said shelves during the germination and early growing cycle of seeds and seedlings.

2. The seedling house as defined in claim 1 wherein said shelves are disposed in rearwardly ascending relation from the forward lower aspect of said side walls to the upper rearward aspect of said sidewalls.

3. The seedling house as defined in claim 2 wherein said sidewalls are generally right-triangularly shaped and the base of said triangle forms the base of said side wall and said shelves are disposed in ascending relation adjacent the hypotenuse of said triangle.

4. The seedling house as defined in claim 3 wherein said side walls along said hypotenuse contain cut-out portions between adjacent shelves in ascending relation whereby said shelf support means are integral with said cut-out portions in step-wise relation.

5. The seedling house as defined in claim 2 wherein said sidewalls are generally right-triangularly shaped and a base of said triangle forms the base of aid side wall and the edge of said sidewall at the hypotenuse of said triangle is arcuate having said hypotenuse as a chord thereof and said shelves are disposed in ascending relation adjacent said arcuate edge.

6. The seedling house as defined in claim 3 wherein said seedling house includes a removable translucent cover which when in assembled relation is disposed over said shelves and is generally supported by said side walls adjacent said shelves and said shelves.

7. The seedling house as defined in claim 5 wherein said seedling house includes a removable translucent cover which when in assembled relation is disposed over said shelves and is generally supported by said arcuate edges of said side walls adjacent said shelves and said shelves.

8. The seedling house as defined in claim 3 wherein a removable brace is disposed between said side walls adjacent the base thereof generally opposite the lower-most shelf in locking engagement with each of said side walls.

9. The seedling house as defined in claim 5 wherein a removable brace is disposed between said side walls adjacent the base thereof generally opposite the lower-most shelf in locking engagement with each of said side walls.

10. The seedling house as defined in claim 1 including a generally rectangularly shaped case having a top portion and a bottom portion in which said seedling house may be stored in disassembled condition, said bottom portion of said case being disposed with means for engaging said side walls in locking relation whereby said seedling house is structurally supported by said base portion when said seedling house is in assembled condition.

11. The seedling house as defined in claim 1 including lighting means disposed on the underside of at least one of said shelves.

12. The seedling house as defined in claim 1 including lighting means disposed on at least one of said side walls adjacent at least one of said shelves.

* * * * *